US007101031B2

(12) United States Patent
Medin

(10) Patent No.: US 7,101,031 B2
(45) Date of Patent: Sep. 5, 2006

(54) PROPERTY OF AIR DETERMINATION WITHIN IMAGE-FORMING DEVICE

(75) Inventor: Todd R. Medin, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 270 days.

(21) Appl. No.: 10/693,565

(22) Filed: Oct. 25, 2003

(65) Prior Publication Data

US 2005/0088475 A1 Apr. 28, 2005

(51) Int. Cl.
*B41J 2/01* (2006.01)

(52) U.S. Cl. ..... 347/102; 347/14; 347/19

(58) Field of Classification Search ..... 347/15, 347/102, 19, 5, 14, 17; 62/178
See application file for complete search history.

(56) References Cited

U.S. PATENT DOCUMENTS

| | | | | |
|---|---|---|---|---|
| 4,321,607 A | | 3/1982 | Heibein et al. | 346/75 |
| 4,662,622 A | | 5/1987 | Wimmer et al. | 271/96 |
| 5,446,487 A | * | 8/1995 | Russell et al. | 347/102 |
| 5,970,729 A | * | 10/1999 | Yamamoto et al. | 62/178 |
| 6,511,146 B1 | * | 1/2003 | Ishikawa et al. | 347/15 |

FOREIGN PATENT DOCUMENTS

| | | |
|---|---|---|
| EP | 0526884 | 2/1993 |
| JP | 06130770 | 5/1994 |
| JP | 09156088 | 6/1997 |
| WO | WO94/19197 | 9/1994 |

OTHER PUBLICATIONS

European Search Report dated Feb. 2, 2005.
SEIKO, "Direct Thermal Printing" brochure, www.siiprinters.com, copyright 2003.
Wikipedia entry for "Dye-sublimation printer," en.wikipedia.org/, last modified Apr. 12, 2006.
KODAK "Thermal media products," www.kodak.com, accessed from Internet May 1, 2006.

* cited by examiner

*Primary Examiner*—Stephen D. Meier
*Assistant Examiner*—Lam S. Nguyen

(57) ABSTRACT

A method of one embodiment of the invention is disclosed that determines a property of air within an image-forming device based on a measured change in air temperature within the device, the power supplied to a heating element of the device, and an air flow generated by an air-moving device. One or more parameters of the image-forming device are adjusted, based on the air density determined.

38 Claims, 2 Drawing Sheets

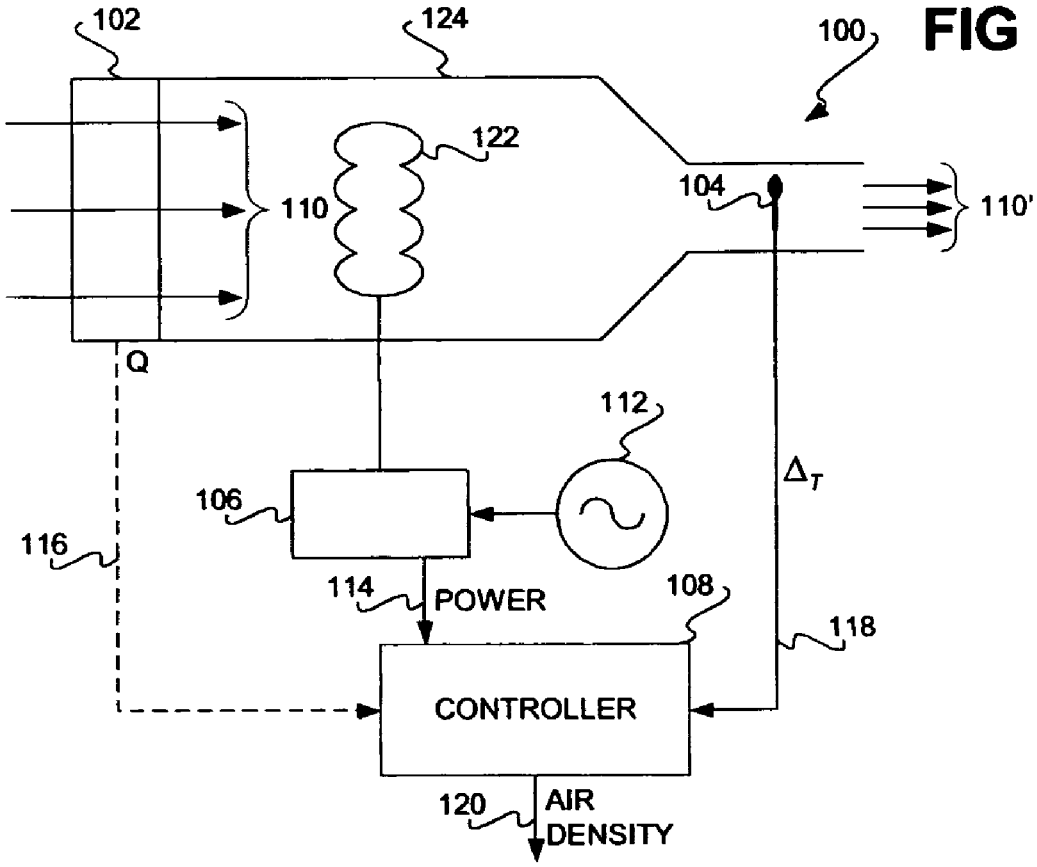
FIG 1
FIG 2
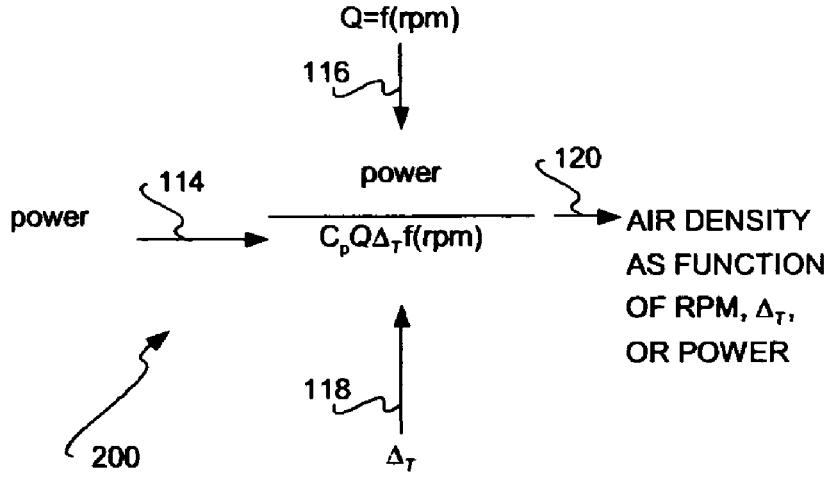

PROPERTY OF AIR DETERMINATION WITHIN IMAGE-FORMING DEVICE

BACKGROUND

Inkjet and laser printers have become popular for printing on media. For instance, such printers have become popular for printing black-and-white and color image files generated using digital cameras, for printing copies of business presentations, and so on. Most computer users today employ some type of printer in order to generate hard copies of digital information. A printer is more generically an image-forming device that forms images onto media, such as paper.

Fans may be used in printers for a variety of different reasons. A fan may be used to create a vacuum, to hold down media at a specific location for optimal print quality. A fan may also be used to convectively cool the components of a printer. Alternatively, a fan can be used in conjunction with a heater of an inkjet printer to heat media, so that ink applied to the media dries more quickly. The fan may also be used to exhaust fumes and ink aerosol away from the media.

For achieving desired performance levels of such fans, knowledge of the local air density is useful. For vacuums, knowing the air density within a printer assists in maintaining a relative pressure between the two sides of the media. For heating and cooling, knowing the air density helps to maintain a consistent air mass flow. Other printing parameters that benefit from knowing the air density include ink drying time, the temperature of the heated air moved by the fan, and the media advancement speed through the printer.

BRIEF DESCRIPTION OF THE DRAWINGS

The drawings referenced herein form a part of the specification. Features shown in the drawing are meant as illustrative of only some embodiments of the invention, and not of all embodiments of the invention, unless otherwise explicitly indicated.

FIG. 1 is a diagram of an embodiment of a fan assembly for an image-forming device, according to an embodiment of the invention.

FIG. 2 is a diagram illustratively depicting an example of how air density within an image-forming device may be determined, according to an embodiment of the invention.

DETAILED DESCRIPTION OF THE DRAWINGS

Figure 3:
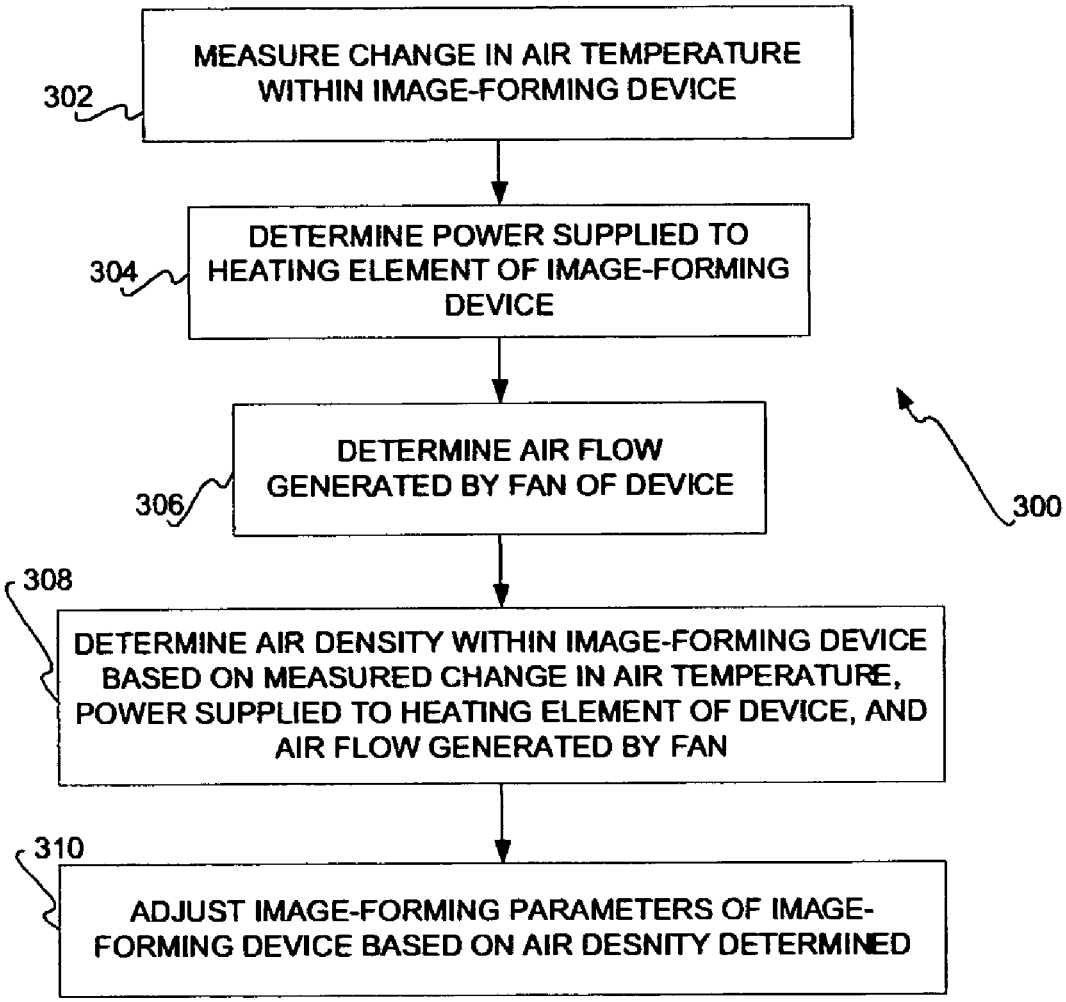
FIG. 3 is a flowchart of a method for determining air density within an image-forming device, according to an embodiment of the invention.

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the embodiments of the invention. Other embodiments may be utilized, and logical, mechanical, and other changes may be made without departing from the spirit or scope of the appended claims. The following detailed description is, therefore, not to be taken in a limiting sense, and the scope of the present invention is defined only by the appended claims.

Fan Assembly for Image-Forming Device

FIG. 1 shows an embodiment of an air-moving device, such as fan assembly 100, for an image-forming device, according to an embodiment of the invention. The fan assembly 100 includes a fan 102, a temperature sensor 104, a power input 106 for a heating element 122, and a controller 108. The fan 102 is positioned at the input of a duct 124, the heating element 122 is positioned within the duct 124, and the temperature sensor 104 is positioned at the output of the duct 124. The fan assembly 100 may have one or more functions within the image-forming device. As depicted in FIG. 1, the fan assembly 100 is specifically to generate air flow 110, which is then heated by the heating element 122 to result in heated air flow 110', to heat media to dry ink applied to the media within the device.

The heating element 122 may be a resistive heating element, or another type of heating element. The heating element 122 receives power from a power source 112 through a power input 106. The power input 106 may be a connector, a direct connection to the power source 112, or another type of power input. The power supplied to the heating element 122 from the power source 112 through the power input 106 is referred to as the power 114, and may be denoted in watts (W).

The fan 102 also receives power from the power source 112, which is not explicitly depicted in FIG. 1. The fan 102 generates the air flow 110 through the duct 124, and that is output as the air flow 110'. The air flow 110 is also referred to as the value Q 116, and can be expressed in cubic meters per second ($m^3/s$). The duct 124 is specifically a known and consistent duct. However, it should be recognized that a wide variety of differently shaped ducts and differently shaped ducts may be used.

The temperature sensor 104 measures the change in air temperature within the image-forming device that results from the air flow 110 generated by the fan 102, as heated by the heating element 122. For instance, the sensor 104 may measure an initial temperature before the fan 102 has been turned on, and then wait a length of time before measuring another temperature after the fan 102 has been turned on to determine the change in air temperature. The change in temperature is referred to as $\Delta_T$ 118.

The controller 108 may be hardware, software, or a combination of hardware and software. For instance, the controller 108 may be or be part of an application-specific integrated circuit (ASIC). The controller 108 receives the values power 114, and $\Delta_T$ 118, and is able to calculate the value Q 116 based on other values received, such as fan revolutions-per-minute (rpm). The value Q 116 is particular to a given fan 102 and a given duct 124. From these values, the controller 108 determines a property of air, such as the air density 120, within the image-forming device, as is specifically described in the next section of the detailed description.

The controller 108 adjusts operating characteristics of the fan 102 to affect image-forming parameters of the image-forming device, and thus effectively adjusts the image-forming parameters of the device, based on the air density 120 determined. For example, the controller 108 may adjust a revolutions-per-minute (rpm) parameter of the fan 102, which determines the speeds of the blades of the fan 102, and thus the air flow 110 through the fan 102. The controller 108 may adjust the rpm parameter of the fan 102 in one embodiment by adjusting the power supplied to the fan 102. Other parameters of the device, besides image-forming parameters, may also be adjusted, such as timing delays based on the air density determined, and so on.

By adjusting these operating characteristics of the fan 102, the controller 108 is able to adjust different image-forming parameters of the image-forming device. For example, where a fan other than the fan 102 is used to hold down media via a vacuum, the relative pressure between the sides of the media advancing through the device may be maintained substantially at a desired pressure difference. As another example, where the fan 102 is used for heating, or a fan other than the fan 102 is used for cooling, a consistent air mass flow by the fan in question may be maintained. A fan other than the fan 102 may be employed for exhaust purposes, to exhaust fumes or ink aerosol away from media. Other image-forming parameters that can be adjusted by the controller 108 based on the air density 120 include the time needed to dry ink output onto the media within the image-forming device, the temperature of the heated air moved by the fan 102, the speed of media advancement through the device, and so on.

Determining Air Density

The air density within an image-forming device is generally determined in one embodiment in accordance with the equation:

$$\text{air density} = \frac{\text{power}}{C_p Q \Delta_T}. \tag{1}$$

In equation (1), power is the power supplied to the heating element 122, as referenced by the reference number 114 in FIG. 1, Q is the air flow 110 generated by the fan 102, which is referenced by the reference number 116 in FIG. 1, although the value Q is actually determined on the basis of the revolutions-per-minute (rpm) of the fan 102, and $\Delta_T$ is the change in temperature resulting from the air flow 110 generated by the fan 102, as referenced by the reference number 118 in FIG. 1. Furthermore, $C_p$ is a constant, and is the specific heat of air, which is known a priori. The value air density that is determined in equation (1) is the air density 120 in FIG. 1.

FIG. 2 shows a diagrammatical representation 200 of equation (1), according to an embodiment of the invention. The air flow 110 generated by the fan 102, as indicated by the value Q 116, is known as a function of the rpm of the fan 102. That is, the value Q 116 is known as a function of the speed of the fan 102. This may be known as a result of specifications regarding the fan 102 and the duct 124 provided by the manufacturer of the fan 102, or as a result of empirical study of the fan 102. These specifications may be based upon calibration at the point of manufacture, at the factory, or when installed at a given customer, end-use site. As before, the value power 114 is the power supplied to the heating element 122 through the power input 106 from the power source 112, and the value $\Delta_T$ 118 is the change in temperature resulting from the air flow 110 generated by the fan 102.

The air density 120 is thus determined based on the values Q 116, power 114, and $\Delta_T$ 118, as well as on the specific heat of air $C_p$. Different approaches may specifically be employed to determine the air density 120 in accordance with equation (1), as diagrammatically represented in FIG. 2. The air density 120 may be determined as a function of the rpm of the fan 102—that is, as a function of the value Q 116. The air density 120 may also be determined as a function of the change in temperature resulting from the air flow 110 generated by the fan 102—that is, as a function of the value $\Delta_T$ 118. Finally, the air density 120 may be determined as a function of the power supplied to, or consumed by, the heating element 122—that is, as a function of the value power 114.

In other words, different approaches to determine the air density 120 in accordance with equation (1), as diagrammatically represented in FIG. 2, may be employed based on which values are known or fixed, and which variables are not known and variable. For instance, where function of the rpm of the fan 102 is not known and variable, the air density 120 may be determined as a function of the value Q 116. Where the change in temperature resulting from the air flow 110 generated by the fan 102 is not known and variable, the air density 120 may be determined as a function of the value $\Delta_T$ 118. Finally, where the power supplied to, or consumed by, the heating element 122 is not known and variable, the air density 120 may be determined as a function of the value power 114.

FIG. 3 shows a method 300 for determining the air density 120, according to an embodiment of the invention. The change in air temperature within the image-forming device resulting from the air flow 110—the value ΔT 118—is measured (302), such as by using the temperature sensor 104. The power supplied to the heating element 122—the value power 114—is also determined (304). The air flow 110 generated by the fan 102—the value Q 116—is determined (306), such as a function of the rpm of the fan 102. The value Q 116 may be determined based on specifications of the fan 102, or based on empirical study of the fan 102 and the duct 124.

The air density 120 is then determined based on the values $\Delta_T$ 118, power 114, and Q 116 (308), as has been described. This determination may be accomplished as a function of the rpm of the fan—that is, as a function of the value Q 116—or as a function of the value $\Delta_T$ 118 or of the value power 114. Image-forming parameters of the image-forming device are finally adjusted based on the air density 120 that has been determined (310), such as by adjusting operating characteristics of the fan 102. For instance, the relative pressure between the sides of media advancing through the device, and/or the air mass flow for heating or cooling, as affected by the fan 102, may be adjusted based on the air density 120.

Image-Forming Device

Figure 4:
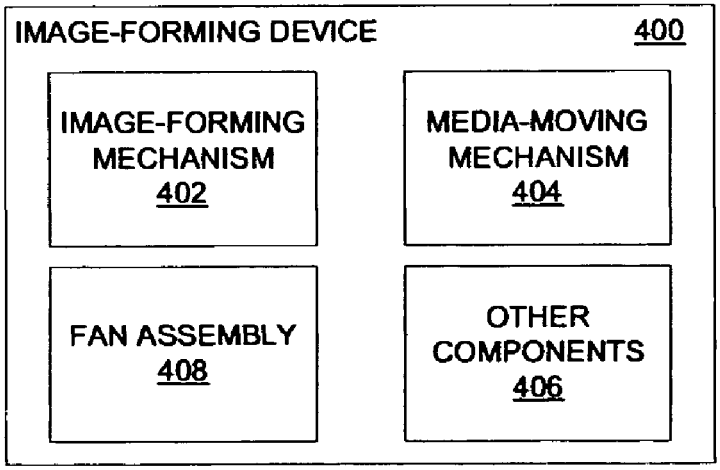
FIG. 4 is a block diagram of an embodiment of an image-forming device, according to an embodiment of the invention.

FIG. 4 shows a block diagram of a representative image-forming device 400, according to an embodiment of the invention. The image-forming device 400 is depicted in FIG. 4 as including an image-forming mechanism 402, a media-moving mechanism 404, other components 406, and a fan assembly 408. The image-forming device 400 may also include other components, in addition to and/or in lieu of those shown in FIG. 4.

The image-forming mechanism 402 includes those components that allow the image-forming device 400 to form an image on the media. For instance, the image-forming mechanism 402 may be an inkjet-printing mechanism, such that the image-forming device 400 is an inkjet-printing device. Furthermore, the media-moving mechanism 404 includes those components that allow the media to move through the image-forming device 400, so that an image may be formed thereon. The media-moving mechanism 404 may include rollers, motors, and other types of components.

The other components 406 include those components, other than those of the fan assembly 408, that may have parameters adjusted based on the air density 120 that is determined. For example, the other components 406 may include a hold-down fan that is used to hold down media while image formation occurs thereon. As another example, the other components 406 may include a cooling fan that is used for cooling the image-forming mechanism 402 or other parts of the image-forming device 400.

The fan assembly 408 can in one embodiment be the fan assembly 100 that has been described in previous sections of the detailed description. For instance, the fan assembly 408 may have operating characteristics that are adjusted based on the determined air density 120. More specifically, the fan assembly 408 can include the fan 102, the operating characteristics of which are adjusted by the controller 108 of the assembly 408 based on the air density 120 that is also determined by the controller 108. The air density 120 is determined based on the air flow 110 generated by the fan 102, the change in air temperature resulting from the air flow 110, and the power supplied to the heating element, as has been described.

CONCLUSION

It is noted that, although specific embodiments have been illustrated and described herein, it will be appreciated by those of ordinary skill in the art that any arrangement calculated to achieve the same purpose may be substituted for the specific embodiments shown. This application is intended to cover any adaptations or variations of the disclosed embodiments of the present invention. For instance, air density or another property of air may be controlled by adjusting the power supplied to the heating element of the image-forming device, and/or on by adjusting the air flow generated by the air-moving device, where such adjustments may be made as has been described. Therefore, it is manifestly intended that this invention be limited only by the claims and equivalents thereof.

I claim:

1. A method comprising:

determining a property of air within an image-forming device based on a measured change in air temperature within the image-forming device, power supplied to a heating element of the image-forming device other than an image-forming mechanism of the image-forming device, and an air flow generated by an air-moving device, the air flow heated by the heating element;

adjusting one or more parameters of the image-forming device based on the property of air determined, including maintaining a consistent air mass flow by the air-moving device for heating functionality thereof; and, using the air flow heated by the heating element to dry colorant on media applied within the image-forming device.

2. The method of claim 1, wherein the property of air is air density.

3. The method of claim 1, wherein the air-moving device comprises a fan.

4. The method of claim 1, further comprising measuring a change in the air temperature within the device to yield the measured change in the air temperature within the device.

5. The method of claim 4, wherein measuring the change in the air temperature within the device comprises utilizing a temperature sensor within the device.

6. The method of claim 1, further comprising determining the power supplied to the heating element of the device.

7. The method of claim 1, further comprising determining the air flow generated by the air-moving device as a function of revolutions-per-minute (rpm) of the air-moving device.

8. The method of claim 7, wherein the air-moving device includes a fan and determining the air flow generated by the fan as the function of the rpm of the fan comprises utilizing predetermined specifications of the fan.

9. The method of claim 7, wherein the air-moving device includes a fan and determining the air flow generated by the fan as the function of the rpm of the fan comprises empirically determining the air flow generated by the fan as the function of the rpm of the fan.

10. The method of claim 7, wherein the air-moving device includes a fan and determining the air density within the image-forming device comprises determining the air density as a function of the rpm of the fan.

11. The method of claim 1, wherein determining the air density within the image-forming device comprises determining the air density as a function of the measured change in the air temperature within the device.

12. The method of claim 1, wherein determining the air density within the image-forming device comprises determining the air density as a function of the power supplied to the heating element.

13. The method of claim 1, wherein determining the air density within the image-forming device comprises determining the air density based on the equation where power is the power supplied to the heating element, Cp is a constant representing the specific heat of air, Q is the air flow generated by the fan, and is the change in the air temperature within the device.

14. The method of claim 1, wherein adjusting the one or more parameters of the image-forming device based on the air density determined comprises maintaining a relative pressure between a first side and a second side of media advancing through the image-forming device, based on the air density determined.

15. The method of claim 1, wherein adjusting the one or more of the image-forming device based on the air density determined comprises maintaining a consistent air mass flow by a second fan for cooling functionality of the second fan.

16. A method comprising:

determining a measured change in air temperature within an image-forming device adjusting at least one of power supplied to a heating other than an image-forming mechanism of the image-forming device, and an air flow generated by an air-moving device, the air flow heated by the heating element, to control air density within the image-forming device, including maintaining a consistent air flow mass by the air-moving device for heating functionality thereof; and, using the air flow heated by the heating element to dry colorant on media applied within the image-forming device, wherein the air density within the image-forming device is based on the measured change in air temperature, the power supplied to the heating element, and the air flow generated by the air-moving device.

17. The method of claim 16, wherein the air-moving device comprises a fan.

18. The method of claim 16, further comprising measuring a change in the air temperature within the device to yield the measured change in the air temperature within the device.

19. The method of claim 16, wherein the air-moving device includes a fan, and adjusting at least one of the power supplied to the heating element of the image-forming device and the air flow generated by the air-moving device comprises adjusting at least an rpm of the fan to adjust the air flow generated by the fan.

20. The method of claim 16, wherein the air density within the image-forming device is based on the equation where power is the power supplied to the heating element, Cp is a constant representing the specific heat of air, Q is the air flow generated by the fan, and is the change in the air temperature within the device.

21. An assembly for an image-forming device comprising:

an air-moving device to generate air flow to dry colorant on media applied within the image-forming device;

a heating element to heat the air flow, the heating element other than an image-forming mechanism of the image-forming device;

a temperature sensor to measure a change in air temperature;

a power source to supply power to the heating element; and, a controller to determine air density based on the air flow generated by the air-moving device, the change in air temperature, and the power supplied to the heating element by the power source, wherein the controller is to adjust one or more operating characteristics of the air-moving device based on the air density determined to affect one or more image-forming parameters of the image-forming device, including maintaining a consistent air mass flow by the air-moving device for heating functionality thereof.

22. The assembly of claim 21, wherein the air-moving device is to generate the air flow to heat media to dry ink applied thereto within the image-forming device.

23. The assembly of claim 21, wherein the controller is to determine the air density based on the equation where power is the power supplied to the heating element, Cp is a constant representing the specific heat of air, Q is the air flow generated by the air-moving device, and is the change in the air temperature.

24. The assembly of claim 21, wherein the fan includes an air-moving device and one or more operating characteristics of the fan adjusted by the controller based on the air density determined comprises a revolutions-per-minute (rpm) parameter of the fan.

25. The fan assembly of claim 21, wherein the one or more operating characteristics of the air-moving device adjusted by the controller based on the air density determined comprises power supplied to the air-moving device.

26. The assembly of claim 21, wherein the one or more image-forming parameters of the image-forming device affected by adjusting the one or more operating characteristics of the air-moving device based on the air density determined comprises a relative pressure between a first side and a second side of media advancing through the image-forming device.

27. The assembly of claim 21, wherein the one or more image-forming parameters of the image-forming device affected by adjusting the one or more operating characteristics of the air-moving device based on the air density determined comprises air mass flow by the air-moving device for heating functionality of the air-moving device.

28. A fan assembly for an image-forming device comprising:

a fan to generate air flow to dry colorant on media applied within the image-forming device;

a heating element to heat the air flow resulting in a change in air temperature, the heating element other than an image-forming mechanism of the image-forming device;

a temperature sensor to measure the change in air temperature;

a power input to couple the heating element to a power source to supply power to the heating element; and, means for determining air density based on the air flow generated by the fan, the change in air temperature measured by the temperature sensor, and the power supplied to the heating element by the power source through the power input, and for adjusting one or more operating characteristics of the fan based on the air density determined to affect one or more image-forming parameters of the image-forming device, including maintaining a consistent air mass flow by the fan for heating functionality thereof.

29. The fan assembly of claim 28, wherein the one or more image-forming parameters of the image-forming device affected by adjusting the one or more operating characteristics of the fan based on the air density determined comprises:

a relative pressure between a first side and a second side of media advancing through the image-forming device; and, air mass flow by the fan for heating functionality of the fan.

30. An image-forming device comprising:

an image-forming mechanism to form images onto media advancing through the image-forming device; and, a fan assembly having one or more operating characteristics adjusted based on an air density determined based on air flow generated by the fan assembly, a change in air temperature, and power supplied to a heating element of the fan assembly other than the image-forming mechanism, to affect one or more image-forming parameters of the image-forming mechanism, including maintaining a consistent air mass flow by the fan assembly for heating functionality thereof, wherein the air flow is heated by the heating element and dries colorant on the media applied within the image-forming device.

31. The image-forming device of claim 30, wherein the image-forming mechanism is an inkjet-printing mechanism, such that the image-forming device is an inkjet-printing device.

32. The image-forming device of claim 31, wherein the fan assembly is to generate the air flow to heat the media to dry ink applied thereto by the image-forming mechanism.

33. The image-forming device of claim 31, wherein the fan assembly is further to generate the air flow to exhaust ink aerosol away from the media.

34. The image-forming device of claim 30, wherein the fan assembly is further to generate the air flow to establish a vacuum to hold down the media.

35. The image-forming device of claim 30, wherein the air density is determined based on the equation where power is the power supplied to the heating element, Cp is a constant representing the specific heat of air, Q is the air flow generated by the fan assembly, and is the change in the air temperature.

36. The image-forming device of claim 30, wherein the one or more operating characteristics of the fan assembly adjusted based on the air density determined comprises a revolutions-per-minute (rpm) parameter of the fan.

37. The image-forming device of claim 30, wherein the one or more operating characteristics of the fan assembly adjusted based on the air density determined comprises the power supplied to the fan assembly.

38. The image-forming device of claim 30, wherein the one or more image-forming parameters of the image-forming mechanisms affected by adjusting the one or more operating characteristics of the fan assembly based on the air density determined comprises a relative pressure between a first side and a second side of the media.

* * * * *

UNITED STATES PATENT AND TRADEMARK OFFICE

CERTIFICATE OF CORRECTION

PATENT NO. : 7,101,031 B2
APPLICATION NO. : 10/693565
DATED : September 5, 2006
INVENTOR(S) : Todd R. Medin It is certified that error appears in the above-identified patent and that said Letters Patent is hereby corrected as shown below:

In column 4, line 22, delete "ΔT" and insert -- $\Delta_T$ --, therefor.

In column 6, line 24, in Claim 13, after "equation"

insert -- $air\ density = \frac{power}{C_p Q \Delta_T}$, --.

In column 6, line 25, in Claim 13, delete "Cp" and insert -- $C_p$ --, therefor.

In column 6, line 27, in Claim 13, after "fan, and" insert -- $\Delta_T$ --.

In column 6, line 42, in Claim 16, after "device" insert -- ; and, --.

In column 6, line 43, in Claim 16, after "heating" insert -- element of the image-forming device --.

In column 7, line 5, in Claim 20, after "equation"

insert -- $air\ density = \frac{power}{C_p Q \Delta_T}$, --.

In column 7, line 7, in Claim 20, delete "Cp" and insert -- $C_p$ --, therefor.

In column 7, line 8, in Claim 20, after "fan, and" insert -- $\Delta_T$ --.

In column 7, line 36, in Claim 23, after "equation"

insert -- $air\ density = \frac{power}{C_p Q \Delta_T}$, --.

In column 7, line 37, in Claim 23, delete "Cp" and insert -- $C_p$ --, therefor.

In column 7, line 39, in Claim 23, after "device, and" insert -- $\Delta_T$ --.

In column 8, line 59, in Claim 35, after "equation"

insert -- $air\ density = \frac{power}{C_p Q \Delta_T}$, --.

UNITED STATES PATENT AND TRADEMARK OFFICE

CERTIFICATE OF CORRECTION

PATENT NO. : 7,101,031 B2
APPLICATION NO. : 10/693565
DATED : September 5, 2006
INVENTOR(S) : Todd R. Medin It is certified that error appears in the above-identified patent and that said Letters Patent is hereby corrected as shown below:

In column 8, line 60, in Claim 35, delete "Cp" and insert -- $C_p$ --, therefor.

In column 8, line 62, in Claim 35, after "assembly, and" insert -- $\Delta_T$ --.

Signed and Sealed this

Seventh Day of April, 2009

JOHN DOLL
*Acting Director of the United States Patent and Trademark Office*